US005733396A

United States Patent [19]

Gerhardt et al.

[11] Patent Number: 5,733,396

[45] Date of Patent: Mar. 31, 1998

[54] PREHEATING PARTICLES IN MANUFACTURE OF PRESSED BOARD

[75] Inventors: Klaus Gerhardt, Rheurdt; Armin Rapp, Kempen; Michael Schöler, Rheurdt; Hans-Dietrich Sitzler, Nettetal-Hinsbeck, all of Germany

[73] Assignee: G. Siempelkamp GmbH & Co., Krefeld, Germany

[21] Appl. No.: 785,239

[22] Filed: Jan. 17, 1997

Related U.S. Application Data

[63] Continuation-in-part of Ser. No. 498,521, Jul. 5, 1995, Pat. No. 5,643,376.

[30] Foreign Application Priority Data

Jul. 6, 1994 [DE] Germany ..... 44 23 632.8

[51] Int. Cl.[6] ..... B27N 1/00; B27N 3/10

[52] U.S. Cl. ..... 156/62.2; 156/296; 156/350; 264/109; 264/DIG. 65

[58] Field of Search ..... 156/62.2, 296, 156/350, 497; 264/109, DIG. 65

[56] References Cited

U.S. PATENT DOCUMENTS 4,945,652 8/1990 Clarke et al. .
5,063,010 11/1991 Fisher et al. .

*Primary Examiner*—Michael W. Ball
*Assistant Examiner*—Sam Chuan Yao
*Attorney, Agent, or Firm*—Herbert Dubno; Andrew Wilford

[57] ABSTRACT

In order to preheat a particle mat having upper and lower faces and edges to a predetermined desired temperature for pressing into a pressed board air is conditioned to a temperature below 100° C. and a moisture content together imparting to the conditioned air a dew point generally equal to the desired temperature. This conditioned air is simultaneously introduced from above and below at the same rate into the respective faces of the mat to produce in the mat a pair of horizontal and vertically approaching fronts at which moisture condenses out of the conditioned air. Introduction of the conditioned air into the mat is ended when condensed moisture and the conditioned air are forced out of the edges of the mat.

1 Claim, 1 Drawing Sheet

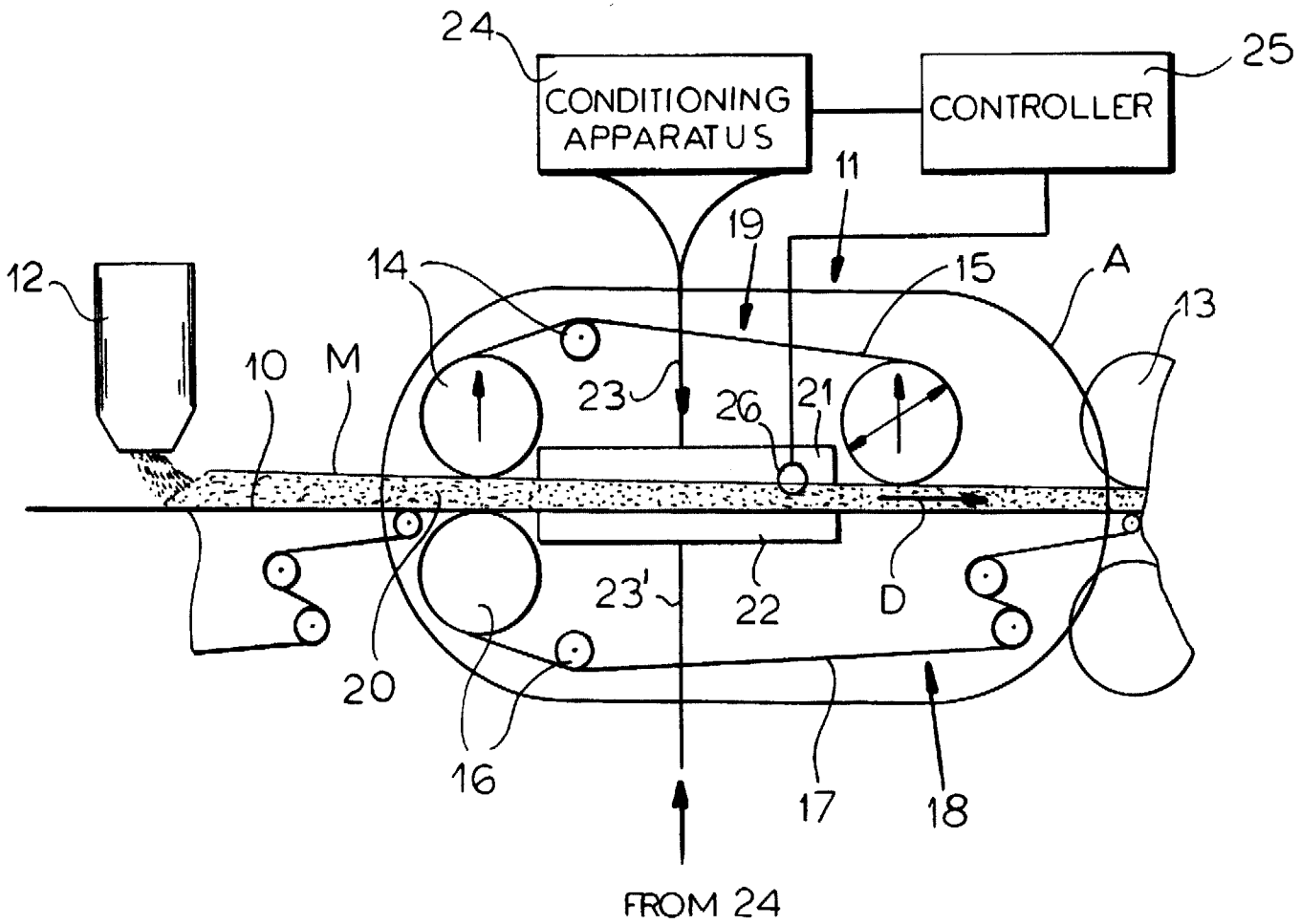
CONTROLLER
CONDITIONING APPARATUS
FROM 24
25
24
13
A
15
11
19
21
26
23
23'
22
D
18
17
16
14
20
M
10
12

PREHEATING PARTICLES IN MANUFACTURE OF PRESSED BOARD

CROSS REFERENCE TO RELATED APPLICATION

This application is a continuation-in-part of application Ser. No. 08/498.521 filed 5 Jul. 1995 now U.S. Pat. No. 5.643.376 with a claim to the priority of German patent application P 44 23 632.8 filed 6 Jul. 1994.

FIELD OF THE INVENTION

The present invention relates to method of making pressed board. More particularly this invention concerns a method of preheating particles for the manufacture of pressed board.

BACKGROUND OF THE INVENTION

Particle board is typically made by depositing on a belt a thick mat of glue-coated particles, in the case of oriented strand board fibers between 75 mm and 150 mm long, preferably between 100 mm and 120 mm, and about 0.75 mm thick. The mat is then heated and pressed to the desired finished thickness. The pressing can be done continuously in an apparatus such as described in commonly owned U.S. Pat. No. 5.336.077 or in an intermittently operating platen-type press.

In the above-identified parent application a method is described whereby a pressed board is heated by concurrently passing through the mat treatment air coming from an air-conditioning system and having a predetermined moisture content and dew point, heating the treatment air passing through the mat to a temperature which is greater by a dew-point differential than the dew point of the treatment air, and controlling the volume rate of flow of the treatment air and the moisture content of the treatment air such that the mat is preheated to a predetermined temperature while moisture or liquid in the treatment air is allowed to condense in the mat to at most a maximum liquid content.

The temperature and moisture content of the prewarming treatment air are controlled as is standard in air-conditioning technology, normally by simply heating the treatment air while evaporating in it enough water to achieve the desired moisture content. The dew point of course is the temperature at which moisture will precipitate out of the treatment air stream, that is the temperature where with a given moisture content the relative humidity of the treatment air reaches 100%. The dew-point differential is a measurement of the moisture of the treatment air. It is the difference between the ambient treatment air temperature and the dew point. A large dew-point differential indicates a high saturation deficiency of the treatment air, that is relatively dry treatment air, and on the contrary a small dew-point differential indicates a higher moisture content, that is relatively humid treatment air. The moisture content here refers as is standard to the water-vapor content of the treatment air as relative humidity. With a relative humidity of 100% the treatment air is saturated with water vapor and excess water vapor will condense out.

In the preheating of loose particulate matter in the production of pressed board the volume rate of flow of the treatment air, the dew point, and the dew-point differential (and also the treatment time) can be set without difficulty so that the predetermined preheating temperature for the preheated workpiece is attained. The concrete values are determined experimentally for the workpiece in question, whether glue-coated or not. The moisture content of the preheated workpiece can surprisingly be set very accurately when necessary as described below.

The treatment air has a temperature above 90° C., preferably above 100° C. The treatment air has a relative humidity of less than 40%, preferably less than 30%. The condensation of the water vapor in the mat is at most 5%. The temperature of the treatment air is set so that it is at least 20°, preferably at least 30° above the temperature to which the mat is to be preheated. This avoids excess condensation in the workpiece. The moisture content and temperature of the treatment air are set by recirculating the treatment air after it traverses the mat through an air-conditioning plant.

In order to set the desired moisture content in the preheated mat there are several possibilities within the scope of this prior invention. The mat can be dried prior to passing the treatment air through it so as to reduce the mat's moisture content to compensate for the moisture subsequently regained by condensation from the treatment air passed through it. This drying can be effected by passing through the mat pretreatment air having the same dew point as the treatment air used to preheat it but having a higher dew-point differential. Alternately when the mat includes wood particles and an adhesive needing a predetermined water content for activation, the mat is dried prior to treatment to a lower water content than the content necessary for adhesive activation and the lacking water is condensed out of the treatment air as it is passed through the mat. Furthermore after prewarming the mat can be dried. When the pressed board is being made up of several layers, it is frequently only necessary to preheat the middle layer or layers.

Normally the mat is continuously formed and is continuously passed through a preheating station where the method is carried out. The preheated mat is then passed through a belt-type continuous press for formation into the finished pressed board. Alternately the mat can be cut into sections that are preheated and subsequently loaded into a batch-type platen press or the like that works discontinuously, that is where the mat sections are stationary during the pressing operation.

The prewarming is done symmetrically, that there is a homogenous distribution of the preheating temperature over the thickness of the mat. In order to achieve this according to the earlier invention the treatment air is passed vertically through the mat. More particularly the treatment air is introduced into the mat from above and from below. The treatment air can be applied simultaneously from above and below at a single location, or at a series of succeeding locations in a continuous process, or alternately from above, then from below. Normally immediately after the mat is prewarmed it is pressed.

Such a system is relatively effective but leaves room for improvement, in particular with respect to the uniformity of distribution of moisture in the preheated mat.

OBJECTS OF THE INVENTION

It is therefore an object of the present invention to provide an improved method of preheating a mat for making pressed board.

Another object is the provision of such an improved method of preheating a mat for making pressed board which overcomes the above-given disadvantages, that is which distributes the moisture with nearly perfect uniformity in the mat.

A further object is the provision of an improved apparatus for carrying out the method.

SUMMARY OF THE INVENTION

In order to preheat a particle mat having upper and lower faces and edges to a predetermined desired temperature for pressing into a pressed board air is conditioned to a temperature below 100° C. and a moisture content together imparting to the conditioned air a dew point generally equal to the desired temperature. This conditioned air is simultaneously introduced from above and below at the same rate into the respective faces of the mat to produce in the mat a pair of horizontal and vertically approaching fronts at which moisture condenses out of the conditioned air. Introduction of the conditioned air into the mat is ended when condensed moisture and the conditioned air are forced out of the edges of the mat.

The rate at which the conditioned air is forced into the mat determines the treatment time, that is how long it takes for the mat to reached the desired preheat temperature. In addition the moisture n the preheated mat, both on and beneath its surface, is determined by the dew-point differential of the conditioned air.

The invention is based on the recognition that it is possible to achieve a very homogenous temperature distribution on preheating when the dew point of the conditioned preheating air is equal to the desired preheat temperature of the mat. The result is an extremely uniform distribution of the moisture used to activate the adhesive binder in the mat, for an extremely strong finished pressed board. Since the moisture both on and beneath the surfaces of the preheated board is determined by the dew-point differential of the conditioned board, it is possible to set it very accurately.

According to the invention the conditioned air is fed through perforated plates to the mat as it passes. The system can work continuously or in steps, but either way will be sure to produce a product of excellent uniformity.

BRIEF DESCRIPTION OF THE DRAWING

The above and other objects, features, and advantages will become more readily apparent from the following description, reference being made to the accompanying drawing whose sole FIGURE is a largely diagrammatic representation of the instant invention.

SPECIFIC DESCRIPTION

As seen in the drawing a preheating apparatus has an input conveyor belt 10 on which a mat M is formed by a particle-depositing hopper 12 so that it moves in a direction D through a prewarming machine 11 to a continuous belt-type press 13. Inside the prewarming apparatus 11 the mat M runs between lower and upper conveyor systems 18 and 19 having respective foraminous belts 17 and 15 spanned over rollers 16 and 14 and forming a passage or nip 20 in which the mat M may be compressed somewhat.

An air-conditioning apparatus 24 feeds humidified hot treatment air via conduits 23 and 23' to upper and lower compartments 21 and 22 so this air diffuses downward and upward through the mat M. A controller 25 connected to the apparatus 24 and to a sensor 26 that detects when moisture starts to exit from edges of the mat M operates the conditioner 24 to stop admission of more air in this system which normally operates in steps, treating one section of the mat M after another.

We claim:

1. In a method of preheating a particle mat having upper and lower faces and edges to a predetermined desired temperature for pressing into a pressed board, the steps of:

conditioning air to a temperature below 100° C. and a moisture content together imparting to the conditioned air a dew point generally equal to the desired temperature;

simultaneously introducing the conditioned air from above and below at the same rate into the respective faces of the mat to produce in the mat a pair of horizontal and vertically approaching fronts at which moisture condenses out of the conditioned air; and ending introduction of the conditioned air into the mat when condensed moisture and the conditioned air are forced out of the edges of the mat.

* * * * *